United States Patent [19]

Gowan, Jr.

[11] Patent Number: 4,505,754

[45] Date of Patent: Mar. 19, 1985

[54] PROCESS FOR FOAM LOWERING AND IMPROVEMENT OF ALUM SENSITIVITY OF DISPERSED SIZE

[75] Inventor: John W. Gowan, Jr., Mt. Pleasant, S.C.

[73] Assignee: Westvaco Corporation, New York, N.Y.

[21] Appl. No.: 533,432

[22] Filed: Sep. 19, 1983

[51] Int. Cl.[3] ..... C08L 93/04

[52] U.S. Cl. ..... 106/238; 162/180

[58] Field of Search ..... 106/238; 260/101, 458 C; 162/180

[56] References Cited

U.S. PATENT DOCUMENTS

| | | | |
|---|---|---|---|
| 1,947,498 | 2/1934 | Scholz | 134/50 |
| 2,176,423 | 10/1939 | Jaeger | 260/481 |
| 2,199,206 | 4/1940 | Maters et al. | 134/1 |
| 2,873,203 | 2/1959 | Hopkins et al. | 106/238 |
| 4,071,375 | 1/1978 | Ishibe et al. | 106/238 |
| 4,148,665 | 4/1979 | Kulick et al. | 106/238 |
| 4,199,369 | 4/1980 | Hughes et al. | 106/238 |
| 4,267,099 | 5/1981 | Okumichi et al. | 260/101 |
| 4,309,338 | 1/1982 | Okumichi | 106/238 |

FOREIGN PATENT DOCUMENTS 1113248 5/1968 United Kingdom .

OTHER PUBLICATIONS

*Chemical Abstracts,* "Esters of Sulfodicarboxylic Acids," 30:1466–1467, (1936).

*Chemical Abstracts,* "Aqueous Rosin Dispersions," 91:125219p, (1979).

*Primary Examiner*—Theodore Morris

*Attorney, Agent, or Firm*—Terry B. McDaniel; Richard L. Schmalz

[57] ABSTRACT

A sulfonated dicarboxylic acid is disclosed as a cosurfactant for its efficacy in lowering foam in alum-containing aqueous dispersed rosin size, and particularly in calcium-containing dispersed rosin size systems. The sulfonated dicarboxylic acid additive also enhances alum sensitivity of the dispersed rosin size. The addition of dioctyl sodium sulfosuccinate, DSS, cosurfactant to a salt of sulfuric acid half ester surfactant-containing dispersed rosin size lowers the tendency for foaming and increases the sensitivity of the size to alum with an attendant increase in sizing efficiency.

8 Claims, No Drawings

PROCESS FOR FOAM LOWERING AND IMPROVEMENT OF ALUM SENSITIVITY OF DISPERSED SIZE

BACKGROUND OF THE INVENTION

This invention relates to a process for preparing aqueous dispersions of rosin-base materials, and more particularly to a process for preparing aqueous dispersed size of enhanced alum sensitivity and lowered tendency to foam.

Cellulose fiber products such as paper and paperboards are produced from an aqueous slurry, or furnish, of cellulose fibers containing sizing agents admixed therewith. These sizing agents generally comprise aqueous dispersions of rosin, especially fortified rosin, which is utilized to modify the surface of the paper to control water penetration. Such sizing is termed internal sizing and is an important step in the wet end operation of a paper machine.

Rosin, or rosin acid, itself has no affinity for cellulose fiber and must be anchored to the surface of the cellulose fiber with a cation such as an aluminum ion normally derived from alum. The rosin acid size and aluminum ions do not react in solution but are codeposited on the fiber surface. The size is held on the pulp fiber by electrostatic forces. This rosin acid size is not yet hydrophobic, but it becomes water-repellent after interaction with the alum in a subsequent heat curing step. The curing occurs when rosin size melts in the drier section of the paper machine and the molten rosin acid spreads over the fiber surface and reacts with neighboring alum adsorbed on it. The resulting aluminum-rosinate is to a large extent responsible for the degree of water repellency of the paper product.

Attention is directed to the disclosures of related U.S. Pat. Nos. 4,267,099 and 4,309,338 to Okumichi et al for an in depth discussion of a method of preparing a dispersed rosin size by the inversion method, which patents are incorporated by reference herein.

Okumichi et al provide a process for preparing an aqueous dispersion of a rosin-base material by the inversion method characterized by reduced foaming properties achieved by use of at least one of the dispersants disclosed and claimed therein. While dispersed rosin size prepared in accordance with Okumichi et al and particularly sizes produced with a dispersant selected from the salts of sulfuric acid half ester of formula II of U.S. Pat. No. 4,267,099, referred to by Okumichi et al as "sulfates," provides dispersed rosin size of reduced foaming properties, the size still tends to produce excessive foam under conditions normally encountered in some papermaking machines.

Okumichi et al thus approached the problem of lowering the tendency of a dispersed rosin size to foam by specifically tailoring the dispersant, or surfactant, albeit they do recognize the obvious expedient of lowering the surfactant level in the size to lower the tendency of the size to foam. Unfortunately, a simple lowering of surfactant level is not practicable because surfactant level is tied to the very ability to produce a dispersion.

Attempts to lower foam generation with dispersed rosin size such as disclosed by Okumichi et al and having a lowered level of the salts of the sulfuric acid half ester of formula II of U.S. Pat. No. 4,267,099 to Okumichi et al, even with the addition of cosurfactants has generally not met with success. Along the same lines, the effect of increased rosin fortification was studied and no appreciable effect on foam generation was noted. However, a detrimental effect on size particle dimension was noted, i.e. the particle size was increased wherein desirable product qualities were compromised without appreciable decrease in foam.

Kawatani et al, in Japanese Kokai No. 79 58, 759, provide another approach to lowering the tendency of aqueous rosin dispersions to foam through the use of internal foam depressors. Kawatani et al teach the use of simple aliphatic acids, e.g., caproic, caprylic, lauric, or myristic, for this purpose. This method of foam lowering is unappealing because the amount of rosin available for sizing is reduced, contaminates with unknown effects are introduced, and the basic problem of inefficient surfactant usage is neglected.

It is known that rosin itself has no affinity for cellulose fiber and is generally anchored to the surface of fiber by utilization of alum. Between pH 4.7 and 5.0, complex polymolecular forms of aluminum ions have been found to be prevalent in a paper making furnish containing alum. This complex $Al_8(OH)_{20}^{4+}$ is highly charged and its OH groups can easily interact with the COOH groups from rosin or cellulose. Adsorption of aluminum on fiber rapidly increases in the pH region where the aluminum complex species is formed.

Thus, a need still exists for a dispersed rosin size of reduced foaming tendency and enhanced alum sensitivity.

SUMMARY OF THE INVENTION

In the practice of the present invention a cosurfactant and optional inorganic salt are disclosed for their efficacy in lowering foam in aqueous dispersed rosin size and enhancing the alum sensitivity of the size. The terminology "alum sensitivity" will be understood to define a measure of the physio-chemical propensity for alum to be well distributed on the furnish fibers to enable the subsequent production of a rosin size precipitate, i.e., aluminum rosinate, in situ, on the furnish fiber surface by interaction of dispersed rosin size particles and alum during a subsequent step of heat curing the paper web. The practice of the present invention enables the provision of dispersed rosin size showing less foaming tendency with relatively little loss of other desirable properties, particularly sizing efficiency, as well as mechanical or shear stability, and settling stability of the rosin size during handling and storage. The improved reduced foam characteristics and enhanced alum sensitivity of dispersed rosin size produced in accordance with this invention are also evident from a consideration of the nature of the foam itself, i.e., the foam bubbles tend to be larger and more easily broken, which effect may in the final analysis be more important than absolute foam level.

With the foregoing in mind it will be appreciated that the principal object of the present invention is the provision of a process for favorably influencing the precipitation of size with alum while lowering the tendency for dispersed rosin size to foam with as little loss of other desirable properties.

It is further another object of the present invention to increase the sensitivity to alum and reduce the susceptibility to foaming of aqueous dispersions of rosin-base material generally prepared in accordance with the teaching of Okumichi et al U.S. Pat. No. 4,267,099 incorporated herein, and particularly dispersions produced in accordance therewith utilizing the "sulfates"

of formula II of the patent through use of a cosurfactant and optionally an inorganic salt.

It is a further object to provide for enhanced alum sensitivity and foam lowering in dispersed rosin size by the utilization of dioctyl sodium sulfosuccinate as a cosurfactant in dispersed rosin size utilizing as primary surfactants the sulfates of formula II of U.S. Pat. No. 4,267,099.

The cosurfactant is added in an amount sufficient to lower the foaming tendency of the aqueous dispersion and increase the sensitivity of the size to alum to provide an attendant increase in sizing efficiency. When the surfactant level is in the preferred range of from about 3.0% to about 3.5% by weight of the rosin-base material, the cosurfactant is added in an amount from about 1.0% to about 3.0% by weight of the rosin-base material. Also, within the preferred surfactant range, the optional inorganic salt can be added in an amount up to about 0.1% by weight of the rosin-base material. When the surfactant level is in the most preferred range of about 3.5% by weight of the rosin-base material, the inorganic salt level is preferably from about 0.04% to about 0.055% by weight of the rosin-base material.

It is another object of this invention to provide a process wherein the level of foam generation in dispersed rosin size, in a dynamic system such as a sizing step in a paper mill, is minimized, or equally as importantly the rate of foam generation is reduced.

A further object of this invention is the provision of a process wherein the deposit of rosin on papermaking machinery can be reduced by enhancing the deposition of the dispersed rosin in or on the paper web.

Still a further object of the present invention is to provide a process wherein the stability to settling, or mechanical stability, of dispersed rosin size is not significantly impaired as a result of the incorporation of foam reducing additives.

DESCRIPTION OF THE PREFERRED EMBODIMENTS

The teaching of Okumichi et al of a process for preparing, by an inversion method, size comprising an aqueous dispersion of rosin-base materials which are improved in accordance with the invention disclosd in copending application Ser. No. 487,338 filed Apr. 21, 1983, which is also herein incorporated by reference for a disclosure of the optional step in the present invention of the addition of a inorganic salt to the dispersant or surfactant "sulfates" of formula II as disclosed and claimed in the U.S. Pat. No. 4,267,099.

Reference is made to U.S. Pat. No. 4,071,375 for a disclosure of fortified rosins as well as a process for their preparation. Reference is made to U.S. Pat. Nos. 2,028,091 and 2,176,423 for a disclosure of the dioctyl sodium sulfosuccinate cosurfactant utilized in carrying forth the present invention.

Dispersed size for tests for quantification of alum sensitivity was produced on a laboratory scale by the following procedure, it being understood that the rosin fortification procedure is not set forth and in this latter regard, the disclosure of U.S. Pat. No. 4,071,375 may be referred to for a known procedure for fortification of rosin such as with fumaric acid. 600 g fortified rosin is charged into a 2 liter resin kettle and the rosin is heated to a temperature of about 165° C. and then cooled to a temperature of about 135° C. and maintained at such temperature for a minimum of five minutes before adding surfactant, or surfactant-salt in those instances where an inorganic salt such as aluminum nitrate, is used in conjunction with the surfactant. When surfactant-salt is utilized, it is prepared by diluting an amount of surfactant corresponding to the desired percentage level relative to the rosin, by weight, which surfactant is then diluted to in the order of about 18% solids. The salt, when utilized, is added to the dilute surfactant and the surfactant added slowly to the rosin in the kettle such as at a rate in the order of 6 ml per minute. The temperature in the kettle normally will drop below 100° C. during this addition and a temperature in the order of about 97°-99° C. should be maintained throughout addition of all surfactants. After all surfactant or surfactant-salt has been incorporated, the mixture is stirred for thirty minutes while maintaining the temperature in the order of about 97°-99° C., after which water addition is commenced. In the first water addition, 65°-95° C. water is added at the rate of 6 ml per minute to adjust the solids to 75%. Stirring of the mixture is then continued for thirty minutes while maintaining the temperature in the order of about 97°-99° C. A second addition of water is then commenced at a slightly faster rate in the order of about 10 ml per minute to adjust the solids content to about 47% while maintaining the temperature in the order of about 97°-99° C. It will be noted that inversion occurs approximately two thirds of the way through this second addition and a temperature decrease of about 1° C. will be observed at the point of inversion. After the second addition of water is completed, the mantle is dropped and all heat to the kettle is cut off. The dispersion in the kettle is allowed to cool to below 60° C. before the addition of a third aliquot of water which water at a temperature in a range of 20° to 35° C. is added at a rate in the order of about 22 ml per minute to adjust the dispersion to 35% solids.

When inorganic salts are employed, they are reagent grade material and are commercially available hydrates. Distilled water was employed unless otherwise specified. Rosin adducts were either produced in the laboratory or pilot plant generally as set forth in the above discussed procedure, or were plant produced commercially available materials where set forth. Particle diameters and sigmas reported were determined using a Nicomp Laser Light scattering instrument.

The principal surfactants employed are those in accordance with the dispersants disclosed and claimed in U.S. Pat. No. 4,267,099 as being selected from the group consisting of (b):

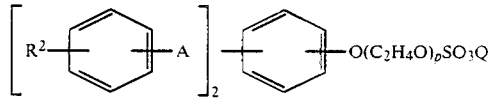

wherein $R^2$ is hydrogen or lower alkyl, A is straight-chain or branched-chain alkylene having 2 to 3 carbon atoms, p is an integer of 4 to 25, and Q is a monovalent cation. More specifically, the surfactant in accordance with U.S. Pat. No. 4,267,099 utilized comprises formula II of the patent wherein $R^2$ is hydrogen and A is a branched-chain alkylene having 3 carbon atoms, p is 13 and Q is a monovalent cation, for example, lithium, sodium, potassium, cesium and like alkali metal ions, ammonium ions derived from ammonia and amines, etc. It will be appreciated that all surfactants within the scope of formula II of U.S. Pat. No. 4,267,099 are suitable for carrying forth the present invention.

The required amount of the optional appropriate salt, based on weight of rosin, is dissolved in a minimum amount of water and added to undiluted surfactant. The surfactant is further diluted to 18% solids. When preparing a dispersion wherein 0.044% aluminum nitrate is used with 600 gms rosin, 0.264 gms aluminum nitrate monohydrate is dissolved in 25 ml water. The water is considered part of the surfactant dilution water and added directly to the undiluted surfactant.

In the examples to follow the dispersed rosin size was prepared according to the method just described which is according to the disclosures incorporated herein.

EXAMPLES 1-5

Dioctyl sodium sulfosuccinate DSS, is disclosed herein as comprising a cosurfactant capable of increasing alum sensitivity in addition to assisting in reducing foaming. In Table I Examples 1 through 5 provide comparisons of dispersed rosin size both with no cosurfactant and at various cosurfactant levels.

Various methods of addition of the DSS to the dispersed rosin size were used and it is observed that there does not appear to be a preferred method or point in time of addition as long as the DSS is intimately admixed throughout the size.

TABLE I

FOAM GENERATION WITH SIZE CONTAINING COSURFACTANTS

| Ex. | Surfactant Level % | Cosurfactant Type | Cosurfactant Level % | Standard* Foam test | Dynamic Drainage Jar Foam Test** (No. $CaCO_3$ | | Dynamic Drainage Jar Foam Test** (with $CaCO_3$ |
|---|---|---|---|---|---|---|---|
| 1 | 3.5 | — | 0 | 20/10/0<br>S S C | 450<br>30 | 550<br>M/D | Out Top in 20 secs |
| 2 | 3.5 | DSS | 1 | 25/15/0<br>S S C | 450<br>42 | 550<br>M/D | 475 550<br>5 M-L/D |
| 3 | 3.5 | DSS | 3 | 30/15/0<br>S S C | 425<br>24 | 450<br>M-L/D | Out Top in 40 secs |
| 4 | 3.0 | DSS | 1.0 | 30/15/0<br>S S C | — | — | 500 425<br>4 M-L/D |
| 5 | 3.0 | DSS | 1.5 | 25/10/0<br>S S C | — | — | Out Top in 25 Secs |

*Standard foam results are reported as first line: highest foam in mls/foam after 30 seconds/foam 30 seconds after completion; second line: bubble size/bubble size (Small, Medium or Large)/breakdown charateristics (Complete, Partial, Unbroken).
**Dyanamic drainage jar (DDJ) foam results are reported in the folowing manner: number in upper left corner equals height of foam in mls at one minute; upper right corner equals maxium foam height; lower left corner is breakdown time in seconds, lower right is bubble size (Small, Medium, or Large) and presence of a deposit on cylinder walls (D). "Out Top" refers to foam generation out the top of the graduated cylinder.

EXAMPLES 6 AND 7

These Examples show that the addition of sodium dioctylsulfosuccinate (DSS) to the invention's dispersed rosin size increases the alum sensitivity of the size by five-fold, which results in an increase in sizing efficiency in the order of 10% or more, as shown in Table II.

TABLE II

| Ex. | Cosurfactant | Rosin Adduct fumaric/formaldehyde | | Alum Sensitivity (milliliters to precipitation) |
|---|---|---|---|---|
| 6 | none | 9.5 | 1 | 20 |
| 7 | DDS | 9.5 | 1 | 4 |

In this test size is titrated with dilute alum solution. The same effect can be demonstrated by adding alum (greater than 1 molar equivalent) to a dilute sample of size. The mixture is stirred and filtered. The untreated size produces a cloudy filtrate from which additional rosin may be recovered. The size with the DSS added, on the other hand, filters cleanly, and no rosin is contained in the filtrate. The principal benefit is that sizing efficiency increases. An additional benefit derived from improved sizing is that rosin deposits on papermaking machinery such as in the press section which have been attributed to build up of rosin particles can be reduced by modifying size in accordance with this invention to insure deposition of a majority of the dispersed rosin size in the paper web.

Mixtures of 50/50 hardwood/softwood pulp were used for these handsheet tests. The pulp was beaten to 75 seconds Williams slowness and treated with 20 pounds/ton alum and 8 pounds/ton size. Sodium hydroxide was used to adjust pH to 4.5 after alum addition. The first four samples were run with baled pulp, the last two in never-dried pulp.

EXAMPLES 8-19

The increased alum sensitivity effect on sizing efficiency was determined by handsheet studies performed on sizes with and without DSS. These sizes had been made with several different fortified rosins. The results are shown in Table III.

TABLE III

SIZING WITH DISPERSED SIZE CONTAINING DSS AS COSURFACTANT

| Ex. | Rosin Adduct fumaric/formaldehyde | | Primary Surfactant Level (%) | DDS Level (%) | Hercules Size Test* (Seconds) |
|---|---|---|---|---|---|
| 8 | 9.5 | 1 | 4.5 | 0 | 183.6 ± 18.7 |
| 9 | 9.5 | 1 | 4.5 | 1 | 249.8 ± 22.3 |
| 10 | 9.5 | 1 | 4.5 | 0 | 134 ± 15.6 |
| 11 | 9.5 | 1 | 4.5 | 1 | 156 ± 9.9 |
| 12 | 9.5 | 1 | 3.5 | 0 | 153 ± 23.3 |
| 13 | 9.5 | 1 | 3.5 | 1 | 231 ± 28.8 |
| 14 | 9.5 | 1 | 3.5 | 0 | 187 ± 12.22 |
| 15 | 9.5 | 1 | 3.5 | 1 | 222 ± 18.8 |
| 16 | 9.5 | 1 | 4.5 | 0 | 131.8 ± 16 |
| 17 | 9.5 | 1 | 4.5 | 1 | 161.1 ± 15.3 |
| 18 | 10 | 1 | 4.5 | 0 | 186 ± 10.4 (Plant Batch) |
| 19 | 10 | 1 | 4.5 | 1 | 213 ± 19.9 (Plant Batch) |

*Standard test for measuring penetration of ink through paper.

The results show longer penetration times for handsheets treated with DDS-containing size which indicate that DSS increases sizing efficiency in handsheets.

Dispersed rosin size with DSS has the following properties: sizing efficiency seems to be increased in handsheets; alum sensitivity is increased without affecting hard water stability, foaming tendencies are reduced somewhat, although air entrainment is not dramatically improved, and mechanical stability and particle size are retained. The use of DSS as a cosurfactant thus results in an improvement over size without this cosurfactant. Lowering the amount of primary surfactant seems not to improve foaming particularly when DSS is used; and therefore, DSS can be used as a cofactor in place of an inorganic salt such as aluminum nitrate for certain applications.

For example, in a mill situation where deposits of size-containing material may accumulate on a doctor blade at press rolls, this may result from size reacting too slowly with alum and not being bound completely into the web permitting a small portion of the later precipitating material finding its way to the doctor blade. Improved sensitivity of the size to alum would help alleviate this situation.

What is claimed:

1. An improved process for modifying the surface of paper to control liquid penetration comprising the interaction of a rosin-based material and alum upon a pulp furnish wherein the aqueous dispersion of a rosin-based material is prepared by mixing together (1) a melt of the rosin-base material, (2) a surfactant selected from the group consisting of at least one salt of sulfuric acid half ester represented by the formula

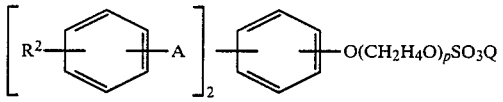

wherein $R^2$ is hydrogen or lower alkyl, A is straight-chain or branched-chain alkylene having 2 to 3 carbon atoms, p is an integer of 4 to 25, and Q is a monovalent cation, and (3) water to obtain a dispersion comprising a continuous phase of the rosin-base material and a dispersed phase of the water, and adding water to the dispersion to invert the dispersion to the contemplated aqueous dispersion comprising a dispersed phase of the rosin-base material and a continuous phase of the water, wherein the improvement comprises the step of adding a cosurfactant consisting of dioctyl sodium sulfosuccinate, said cosurfactant being added in an amount sufficient to lower the foaming tendency of the aqueous dispersion and increase the sensitivity of the rosin-base material to the alum.

2. A process as defined in claim 1 wherein $R^2$ is hydrogen, A is a branched-chain alkylene having 3 carbon atoms, p is 13, and Q is a monovalent cation.

3. A process as defined in claim 1 including addition of an inorganic salt selected from the group comprising chlorides, fluorides, nitrates and sulfates of aluminum, calcium, cobalt, lead, sodium and tin to at least a portion of the surfactant prior to addition of the surfactant to the melt of the rosin-base material.

4. A process as defined in claim 3 wherein the inorganic salt is selected from the group comprising calcium chloride, magnesium chloride, stannous chloride, sodium chloride, sodium fluoride, aluminum nitrate, cobalt nitrate, lead nitrate, aluminum sulfate and mixtures thereof.

5. A process as defined in claim 1 wherein the surfactant level is in the order of about 3.0% to about 3.5% by weight of the rosin-base material, an inorganic salt is present in the order of up to about 0.1% by weight of the rosin-base material the cosurfactant is present in the order of about 1.0% to about 3.0%.

6. A process as defined in claim 5 wherein the surfactant level is about 3.5% and the inorganic salt is present at about 0.04% to about 0.055%.

7. A process as defined in claim 1 wherein the surfactant level is about 3.5% by weight of the rosin-base material and the inorganic salt comprises aluminum nitrate at about 0.04% to about 0.055% by weight of the rosin-base material.

8. A process as defined in claim 2 wherein Q is selected from the group consisting of lithium, sodium, potassium, cesium and ammonium ions derived from ammonia and amines.

* * * * *